US005295347A

United States Patent [19]

Stahlecker

[11] Patent Number: 5,295,347

[45] Date of Patent: Mar. 22, 1994

[54] PROCESS AND AN ARRANGEMENT FOR THE STRENGHTENING OF AN END PORTION OF A YARN

[75] Inventor: Fritz Stahlecker, Bad Überkingen, Fed. Rep. of Germany

[73] Assignee: Hans Stahlecker, Suessen, Fed. Rep. of Germany

[21] Appl. No.: 871,121

[22] Filed: Apr. 20, 1992

[30] Foreign Application Priority Data

Apr. 30, 1991 [DE] Fed. Rep. of Germany ..... 4114069

[51] Int. Cl.[5] ..... D01H 1/20; D01H 15/00; D01H 13/18

[52] U.S. Cl. ..... 57/278; 57/261; 57/269; 57/276; 57/344

[58] Field of Search ..... 57/22, 261, 263, 276, 57/278, 344, 269

[56] References Cited

U.S. PATENT DOCUMENTS

| | | | |
|---|---|---|---|
| 983,641 | 2/1911 | Pease | 57/344 |
| 3,807,270 | 4/1974 | Wirz | 57/22 |
| 4,236,374 | 12/1980 | Marbacher | 57/261 X |
| 4,407,117 | 10/1983 | Garnsworthy | 57/22 |
| 4,653,260 | 3/1987 | Artzt et al. | 57/263 |
| 4,833,874 | 5/1989 | Stahlecker et al. | 57/261 |
| 5,044,150 | 9/1991 | Stahlecker | 57/328 |
| 5,163,279 | 11/1992 | Stahlecker | 57/261 |
| 5,179,828 | 1/1993 | Stahlecker | 57/278 X |

FOREIGN PATENT DOCUMENTS 3909420 9/1990 Fed. Rep. of Germany .

*Primary Examiner*—Daniel P. Stodola
*Assistant Examiner*—William Stryjewski
*Attorney, Agent, or Firm*—Evenson, McKeown, Edwards & Lenahan

[57] ABSTRACT

For the strengthening of an end portion of a yarn which extends on a spinning station of a spinning machine between a stopped spool package and a suction withdrawal device assigned to the spinning station, the yarn which projects into the withdrawal device is gripped, is lengthened by the winding-off of the yarn wound onto the spool package, and is then strengthened in an essentially stationary position by means of a twisting entered in the area of the yarn end. In the case of an arrangement provided for this purpose, particularly mechanically operating twisting devices are used.

34 Claims, 5 Drawing Sheets

PROCESS AND AN ARRANGEMENT FOR THE STRENGHTENING OF AN END PORTION OF A YARN

BACKGROUND AND SUMMARY OF THE INVENTION

This invention relates to a process and an arrangement for the strengthening of an end portion of a yarn which is produced at a spinning station of a spinning machine comprising a plurality of such spinning stations and which, after the interruption of the spinning operation, extends between a stopped spool package and a suction withdrawal device assigned to the spinning station.

In the case of yarn packages which are produced on a spinning machine, the end portion of a spinning yarn must have a certain strength so that, when used on machines which process it further, it can be processed without any disturbance, particularly without any yarn breakage. Particularly in cases where the feeding and threading of the yarn end portion with respect to the machine for the further processing is to take place by means of automatic devices, it is necessary that the yarn end portion has a particularly high strength along a certain length. This requirement exists particularly when the yarn has received only a slight strength during the spinning. This is likely to occur in the case of such yarns where the two yarn components of the yarn were only prestrengthened and were then wound onto the cross-wound package in side-by-side windings. Although the strength of this yarn will be sufficient for the later twisting, yarn breakages can very easily occur when this prestrengthened yarn is processed on the twisting machine or when it is conveyed to the twisting machine.

From the German Patent Document DE-A 39 09 420, it is known that the end portion of a prestrengthened double yarn which is to be placed on a spool package is strengthened during the formation of the final windings. In this case, the double yarn end to be strengthened is held by a machine-side suction withdrawal device and extends to the spool package which is folded away from its drive. A movably arranged servicing device, which is applied to the corresponding spinning station, is equipped with an auxiliary winding roller by means of which the spool package of the respective spinning station can be driven. By means of the auxiliary winding roller, the yarn end portion which is held by the machine-side suction withdrawal device is pulled out of the latter. The strengthening is provided along a length of 0.5 m in such a manner that the yarn portion to be strengthened during the winding-up is guided through a whirl nozzle which is mounted between the machine-side suction withdrawal device and the yarn package. At the whirl nozzle, a pneumatic twisting takes place of the double yarn which is guided through it.

It is an object of the invention to provide a process and an arrangement by means of which, in a simple manner, a particularly effective strengthening of the end portion of a yarn can be carried out.

With respect to the process, this object is achieved according to preferred embodiments of the invention in that the yarn end projecting into the suction withdrawal device is gripped, is lengthened by winding-of f the yarn wound onto the package, and is then strengthened in an essentially stationary position by means of a twisting entered in the area of the yarn end. As a result of these measures, a sufficiently long strengthened yarn end portion is obtained, on the one hand, and, on the other hand, a particularly effective strengthening is achieved because the yarn end portion receives a true twist because of the free yarn end. The twist, which is entered in the stationary position, contributes to a strengthening that can be carried out in a particularly targeted manner. By means of the corresponding winding-of f of the yarn from the package, the length of the yarn end portion which is to be strengthened can be determined.

In a further development of the invention, it is provided that the yarn end portion to be strengthened is held in a clamped fashion during the strengthening. This results in a particularly effective strengthening.

In a further development of the invention, it is provided that the strengthening takes place by a mechanical twisting of the yarn end portion situated between a clamping element and the package. Mechanical twisting is more effective than, for example, pneumatic twisting and can be carried out with fewer expenditures than other types of strengthening, such as the adding of an auxiliary yarn.

In a further development of the invention, it may be provided that the end portion of the yarn which is not intended to be strengthened is cut off. In this manner, it is possible to strengthen a yarn portion of a defined length irrespective of how much yarn is situated in the machine-side withdrawal pipe.

In a further development of the invention, it is provided that the length of the yarn to be strengthened can be determined by the application point of the twisting. As a result, it becomes possible to vary and precisely determine the length of the yarn portion to be strengthened.

In a further development of the invention, it is provided that the yarn end projecting into the suction withdrawal device is gripped by means of a gripping element; together with a yarn portion wound of f the package, is sucked into a suction pipe assigned to the spinning station; and is then strengthened by a twisting entered in the area of the yarn end. As a result of the vacuum acting inside the suction pipe, first a yarn loop is formed to the yarn end portion extending into the withdrawal pipe. When a sufficiently large loop has been sucked into the suction pipe, the gripping element is released so that now yarn wound off the package is taken in. The yarn portion sucked into the suction pipe can then be cut, in which case particularly the yarn portion which previously had projected into the machine-side withdrawal pipe is removed. Finally, the yarn portion extending between a clamping element and the package is strengthened in that the twisting is entered in the area of the yarn end. Thus, the yarn end portion receives a true twist. Since the yarn portion to be strengthened is housed completely in the suction pipe, it is easily possible to strengthen an arbitrary length of yarn without any catching of the yarn portion anywhere.

In the case of a preferred embodiment of an arrangement for carrying out the process, each spinning station of the spinning machine is provided with a withdrawal pipe connected behind a withdrawal device in the yarn travelling direction. Devices for uncoupling the drive are provided on the package receiving the spun yarn. Furthermore, the arrangement has a controllable gripping element which can be applied to the yarn projecting into the withdrawal pipe. By means of the gripping element, the yarn can be guided away from the withdrawal pipe. Furthermore, a twisting device is provided by means of which the yarn end portion leading onto the package can be strengthened by means of a twisting entered in the area of the yarn end. By means of an arrangement of this type, the yarn end portion can be provided with a true twist.

In a further development, it is provided that the twisting device is constructed with a clamping element for the yarn to be strengthened. By means of such a clamping element, the yarn is clamped and, during the strengthening, is situated in an essentially stationary position.

In a further development of the invention, it may be provided that the gripping element and the twisting device are assigned to a servicing arrangement which is movably arranged on the spinning machine and can be selectively applied to the spinning stations. On such movable servicing arrangements, which are known in principle, additional devices may be arranged for carrying out servicing operations. In particular, devices for eliminating a yarn breakage should be mentioned here.

In a further development of the invention, it may be provided that the gripping element and the twisting device are arranged on a common swivel arm which can be applied to the spinning station. The swivel arm, which is arranged on the servicing arrangement, is coupled with a controllable drive. During the travelling movement of the servicing arrangement, the swivel arm is situated inside the servicing arrangement. In the operating Position, the swivel arm is swivelled out of the servicing arrangement. The yarn end is gripped by the gripping element and is guided away from the intake device. The desirable length of the strengthened area can be varied by the swivel position of the swivel arm.

In a further development of the invention, it may be provided that a cutting device is assigned to the twisting device by means of which the end portion of the yarn which is not to be strengthened can be cut off.

In an advantageous embodiment of the invention, a suction pipe is provided which is assigned to the servicing arrangement, can be applied to the withdrawal pipe and, on its mouth opening facing away from the servicing arrangement, is provided with a yarn clamp and, on its opposite opening, is provided with a twisting device. The devices operate in that the yarn clamp constructed as a gripping element first grips the yarn portion in the area of the machine-side withdrawal pipe, in which case it is sucked into the applied suction pipe while forming a loop. As soon as the vacuum existing in the applied suction pipe is sufficiently large, the yarn clamp will release the yarn portion. In this case, another yarn portion, which had been wound off from the package by means of an auxiliary winding roller, is taken in. The yarn portion will then be cut off at a predetermined length and is twisted in the clamped condition. It may also be provided that the cutting device and the twisting device are arranged inside the suction pipe at some distance from its mouth opening. The twisting device may also be arranged such that it is situated at the end of the yarn portion to be twisted. It is also contemplated, however, to let the end of the yarn portion to be twisted enter farther into the suction pipe so that the length of the yarn portion to be twisted can be varied. The length of the yarn portion to be strengthened can be varied by the point of application of the twisting device. This point of application can be changed by the arrangement of the twisting device in the suction pipe, by changing the length of the suction pipe or by swivelling the suction pipe.

In the case of an advantageous further development, it is provided that the twisting device is designed as a rotatably driven tube into which the yarn to be strengthened can be introduced and to which a clamping element is assigned which can fix the yarn.

In an advantageous further development, two clamping devices are provided as the clamping element which can be introduced into the interior of-the tube and can be brought to rest against one another. In this case, the yarn portion to be twisted is brought, for example, sucked, into the interior of the tube. By means of the subsequently entered rotating movement of the tube, the yarn is clamped in by means of the clamping elements and is strengthened at the same time by providing the yarn end portion with a true twist.

It is also possible to establish the contact position of the clamping elements by means of a solenoid acting outside the tube.

In a further development of the invention, it is provided that the clamping elements are developed as wing-type double levers which are received in mutually opposite recesses of the tube and are pivotally arranged on pins in the recesses. The arrangement of the pins takes place in such a manner that a shorter and a longer leg respectively are formed on the double lever. Because of the centrifugal force which occurs when the tube is rotated, the longer legs are moved toward the outside and the shorter legs are therefore moved toward the inside. In this case, the yarn introduced into the pipe is clamped between the shorter legs.

In this case, it may advantageously be provided that the tube has a rectangular cross-section in the area in which the double levers are arranged.

It may also advantageously be provided that the double levers in their inoperative position completely fill the recesses of the tube. In the case of this construction, secondary air is avoided which could impair the suction effect of the tube with respect to the yarn. In the inoperative position of the twisting device, the suction air can flow freely through the clamping element without any impairment.

A particularly simple construction of the arrangement is achieved in that the clamping element of the twisting device is at the same time constructed as a gripping element. In the case of this development, the clamping element must be operable from the outside. The operating may expediently take place in an electromagnetic manner.

In the case of another advantageous development, the twisting device has a rotatably arranged drivable slotted disk with a radially arranged slot which extends to the center. The yarn to be strengthened can be inserted into this slot and can be fixed by means of a yarn clamp arranged on the slotted disk. The yarn to be strengthened is introduced into the slot up to the center and is held by the yarn clamp which can be operated from the outside. Then the disk is rotated. This twists the yarn portion held by the yarn clamp. Other than in the case of the above-described tube-shaped twisting device, in the case of this construction, the yarn portion to be twisted is introduced from the side, in which case it is also easily possible to apply the twisting device to the yarn. A twisting device of this type is recommended in cases where no additional suction pipe is to be used. The yarn clamp may expediently be operable from the outside by means of a solenoid or by means of mechanical devices. However, it is also contemplated to construct the yarn clamp such that it operates with centrifugal force.

In a further development of the invention, the slotted disk can be rotated by means of an assigned driving disk. The driving disk, which is coupled with a drive, transmits its rotating movement to the slotted disk. This provides the yarn which is introduced into the slot of the slotted disk with a true twist. It is also contemplated to arrange several driving disk on the slotted disk.

In an advantageous development, the slotted disk and the driving disk are magnetically connected with one another. Since a conventional radial bearing cannot be used on the slotted disk, the magnetic connection provided between the driving disk and the slotted disk prevents a lateral moving-away of the slotted disk.

In another advantageous development, the slotted disk can be driven by means of two magnetic driving disks which are applied to its circumference. The slotted disk can be secured against a radial displacement by being arranged between rims.

Other objects, advantages and novel features of the present invention will become apparent from the following detailed description of the invention when considered in conjunction with the accompanying drawings.

DETAILED DESCRIPTION OF THE DRAWINGS

Figure 1:
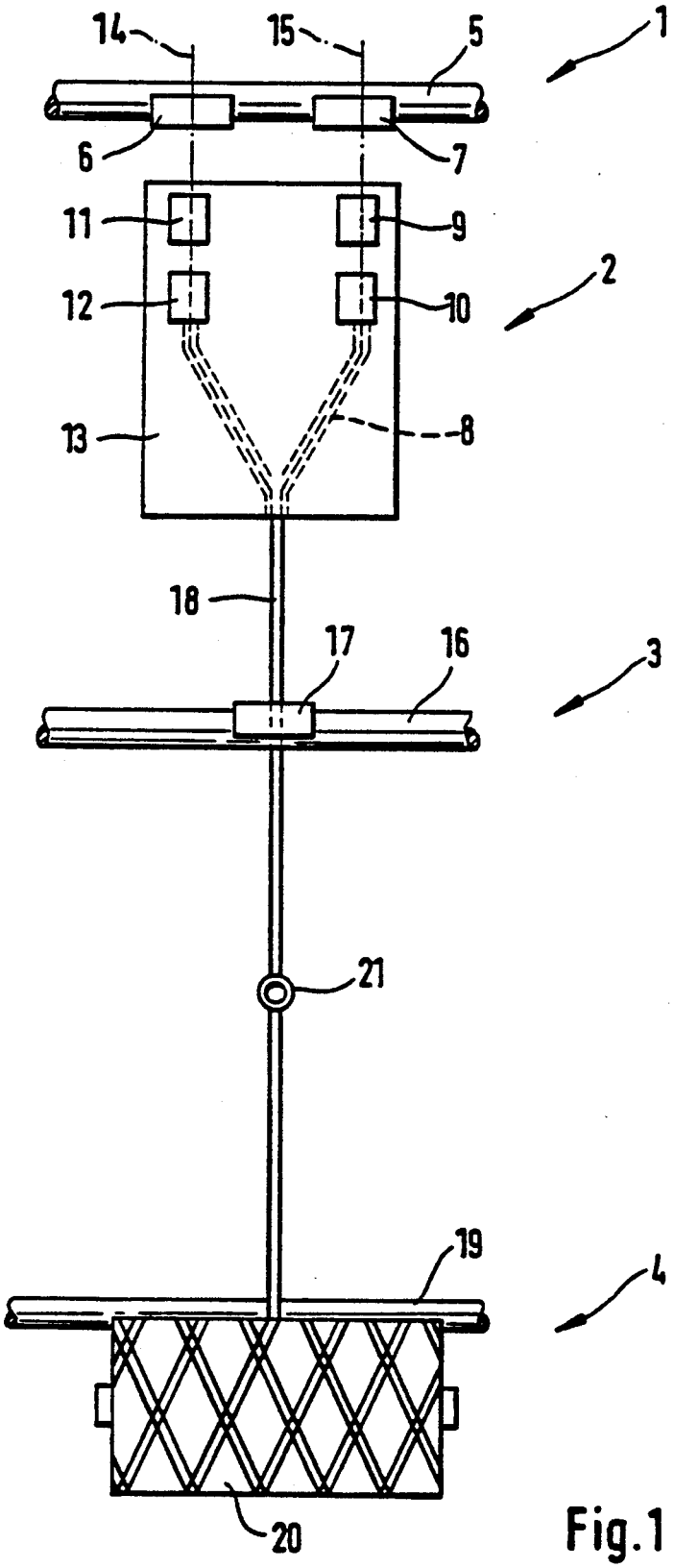
FIG. 1 is a schematic representation of a spinning station at which a yarn is produced which consists of two prestrengthened yarn components.

FIG. 1 is a schematic view of the spinning station of a spinning machine which is not otherwise shown and which has a plurality of such spinning stations. The spinning station essentially comprises a twin drafting unit 1, two spinning elements 2 arranged in parallel to one another, a withdrawal device 3, and a wind-up device 4. Two slivers 14, 15 are fed to the spinning station which are drafted to the desired size by the twin drafting unit 1. Only the bottom delivery roller 5 and the two assigned top delivery rollers 6 and 7 are shown of the twin drafting unit 1. From the twin drafting unit 1, the slivers 14, 15, which are drafted to the desired size, arrive at the spinning elements which are fastened on a plate 13. The spinning elements are air nozzles which are arranged downstream of the delivery rollers 5, 6, 7 of the twin drafting unit 1. In this case, the intake nozzle 11 and the twisting nozzle 12 are assigned to the delivery rollers 5, 6. The intake nozzle 9 and the twisting nozzle 10 are arranged downstream of the oppositely arranged delivery rollers 5, 7. The drafted slivers 14, 15 are sucked into the intake nozzles 9, 11. In the twisting nozzles 10, 12, the slivers 14, 15 receive a twist which opens up again because a false twist is involved. Although the false twist opens up again, the slivers 14, 15 retain a certain strength which is sufficient for further processing.

On the plate 13, a V-shaped duct 8 is arranged which connects to the twisting nozzles 10, 12 and—viewed in the travelling direction of the yarn—leads out approximately at the delivery end of the plate 13. The prestrengthened slivers 14, 15 are guided together through the V-shaped duct 8 so that they are disposed in parallel closely next to one another without contacting one another. The two slivers 14, 15 now represent a double yarn 18 which is withdrawn from the spinning elements 2 by the withdrawal rollers 16, 17 arranged behind them in the travelling direction of the yarn.

On the wind-up device 4, which consists essentially of a winding roller 19, the double yarn 18 is then wound up in side-by-side windings onto the cross-wound package 20. The cross windings are produced by means of a traversing yarn guide which is not shown. Between the withdrawal rollers 16, 17 and the wind-up device 4, a withdrawal pipe 21 is arranged by way of which the double yarn 18 is guided during the spinning operation. The withdrawal pipe 21 is acted upon by suction air either during the whole spinning operation or at least in the case of an operational disturbance. The cross-wound package 20, which is produced at the spinning station of FIG. 1 and onto which the double yarn 18 is wound which consists of the prestrengthened yarn components 14 and 15, is intended for a later twisting.

Figure 2:
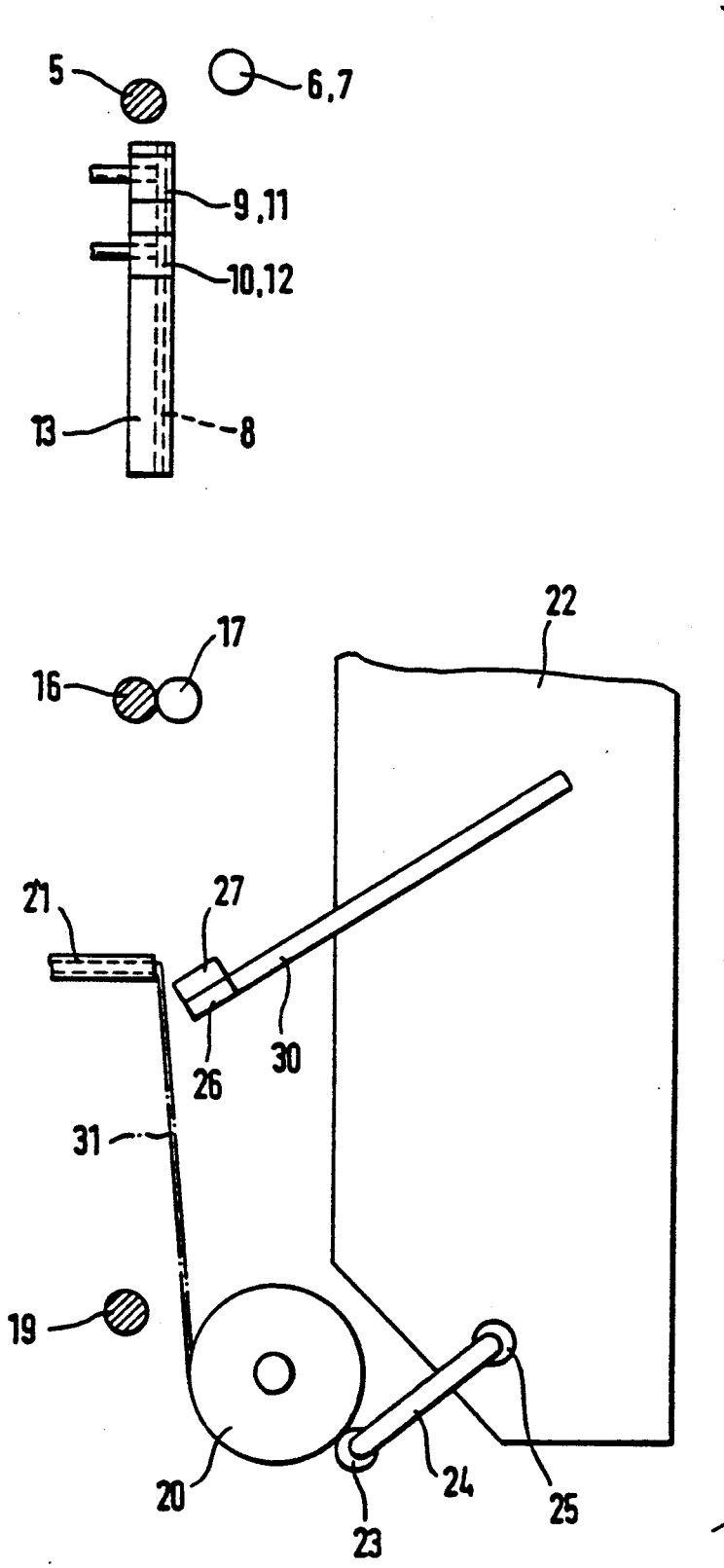
FIG. 2 is a schematic lateral view of the spinning unit according to FIG. 1 with a first embodiment of the invention.

FIG. 2 shows the spinning station of FIG. 1 during an operational disturbance. An operational disturbance exists, for example, when a yarn component is broken. A yarn detector, which is not shown, will then render the respective spinning station inoperative. At the spinning station, the top rollers 6, 7 of the drafting unit are then lifted off the bottom roller 5. The spool package 20 will be disengaged from the winding roller 19 which drives it and will therefore be stopped.. The double yarn 18, which runs out because the drafting unit 1 is rendered inoperative, is held by the withdrawal pipe 21 which is acted upon by suction air. A yarn portion 31, which extends between the lifted-of f cross-wound package 20 and the withdrawal pipe 21, is held in a drawn manner, the yarn end projecting into the withdrawal pipe 21.

The signal of the yarn detector, which is not shown, has called a servicing carriage 22 which is arranged to be movable along the spinning machine, which is also not shown, and can be applied to the spinning stations of the spinning machine. The called servicing carriage 22 is situated in the servicing position in front of the corresponding spinning station. On the servicing carriage 22, a swivel arm 30 is disposed which is connected with a drive which is not shown. During the movement of the servicing arrangement, the swivel arm 30 is situated inside the servicing arrangement 22.

For carrying out the yarn strengthening, the swivel arm 30 is swivelled out of the servicing carriage 22 and is applied to the withdrawal pipe 21 arranged on the machine side. On its free end, the swivel arm 30 is equipped with a twisting device 26 and a yarn clamping device 27. As will be described in detail below, the double yarn 31 is gripped by the yarn clamping device 27 and is subsequently twisted by the twisting device 26. The servicing carriage 22 also has an auxiliary winding roller 23 which is arranged on a lever 24 which can be swivelled about the shaft 25. The auxiliary winding roller 23 may therefore be brought to rest against the spool package 20, which was lifted off the winding roller 19, and drive it. Servicing devices, which are not shown, such as devices for eliminating a yarn breakage, are also arranged on the servicing carriage 22.

Figure 3:
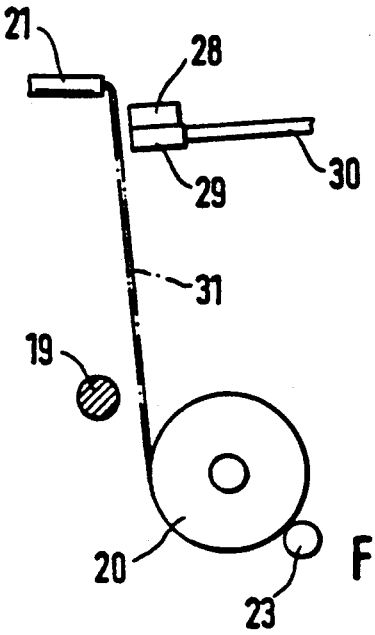
FIG. 3 is another embodiment of the invention which is applied to a spinning station according to FIG. 1.
Figure 4:
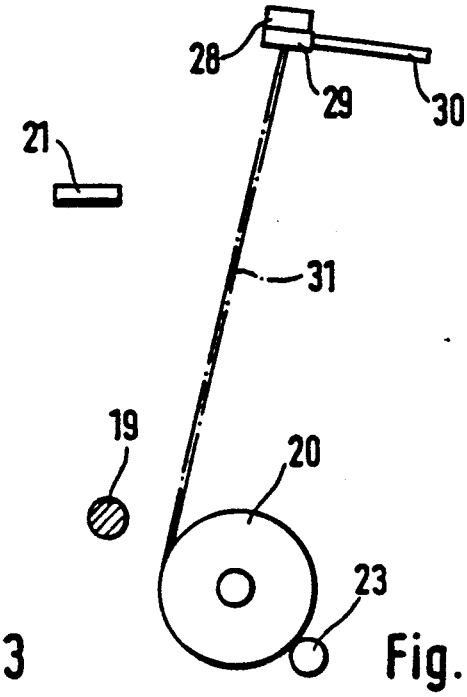
FIG. 4 is a view of the embodiment of FIG. 3 in a later operation.

FIGS. 3 and 4 illustrate a simple embodiment of an arrangement according to the invention. The servicing carriage 22, on which the arrangement is arranged in a similar manner as in the embodiment illustrated in FIG. 2, is not shown in the drawing FIGS. 4 and 5 for reasons of simplification. The double yarn 31 extends from the spool package 20 lifted off the winding roller 19 to the machine-side withdrawal pipe 21 into which the end of the yarn portion 31 projects. A twisting device 29 is applied to the double yarn 31 and is arranged on a swivel arm 30. By means of the twisting device 29, the double yarn 31 can be gripped on the one hand and, and the other hand, can be strengthened. The yarn portion 31 is gripped by a clamping element 56, which is electromagnetically operable from the outside, and is-part of the twisting device 29 which is shown in detail in FIG. 7. A clamping element 56 which is constructed in this manner makes a separate gripping element unnecessary. By means of the swivel motion of the swivel arm 30 holding the twisting device 29, the yarn 31 is guided away from the withdrawal pipe 21 (FIG. 4). In this case, the yarn portion projecting into the withdrawal pipe 21 is pulled out of it. At the same time, the spool package 20 is driven clockwise by means of the auxiliary winding roller 23 so that an additional length of the yarn portion 31 is wound off the spool package 20 when the swivel arm 30 is moved away. As soon as a sufficient length of the yarn portion 31 has been wound of f the spool package 20, the twisting device 29 is actuated so that a true twist is provided to the yarn portion 31 extending between the clamping element 56 and the spool package 20 since the end of the yarn 31 is free. Previously, a cutting device 28 had been actuated which is assigned to the twisting device 29 and which has cut off the yarn portion which previously had projected into the withdrawal pipe 21. For the winding-up of the twisted yarn portion 31 onto the spool package 20, the auxiliary winding roller 23 will then be driven counterclockwise.

Figure 5:
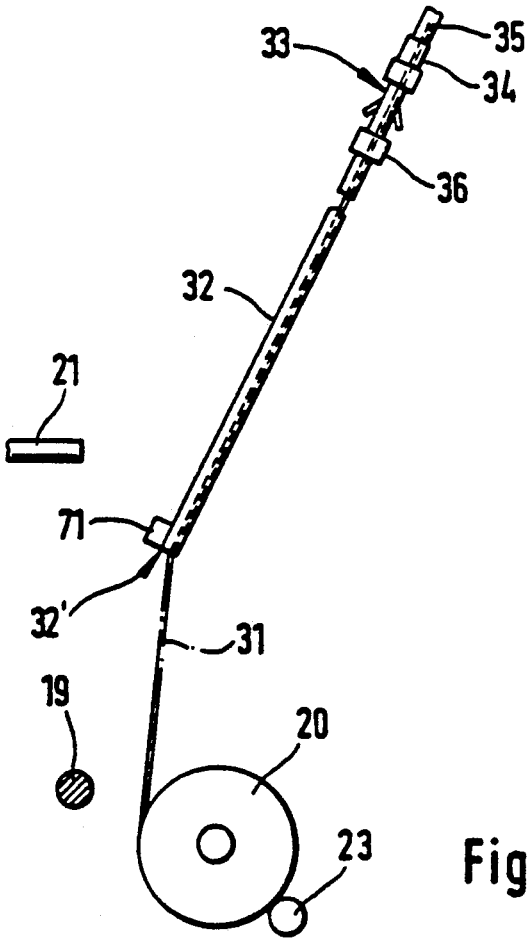
FIG. 5 is a view of another embodiment with a suction pipe which can be applied to the withdrawal pipe of the spinning station.

Another embodiment of the invention is illustrated in FIG. 5. This arrangement is provided with a suction tube 32 which is pivotally arranged on the servicing carriage 22 which is not shown in this drawing FIGURE. In the area of the mouth opening 32' of the suction tube 32, a yarn clamp 71 is disposed which grips the yarn portion 31 projecting into the machine-side withdrawal pipe 21. The spool package 20 is rotated clockwise by means of the-auxiliary winding roller 23. The suction tube 32 sucks in the yarn portion 31, in which case first a loop is formed to the yarn portion extending to the withdrawal pipe 21. The yarn clamp 71, which holds the yarn portion extending to the suction pipe 21, is released as soon as the vacuum existing in the suction tube 32 acts sufficiently strongly on the yarn portion 31 so that it can be pulled out of the withdrawal pipe 21. The yarn loop of the yarn portion 31 is sucked by the suction effect of the suction tube 32 through the twisting device 33 and through the cutting device 34 up to the tube piece 35 which connects to the cutting device 34 and leads to the vacuum source. Then the yarn portion 31 is cut by the cutting device 34, in which case the cut-off end is guided away through the tube piece 35. Subsequently, the twisting device 33 (FIG. 6) is rendered operative.

Figure 6:
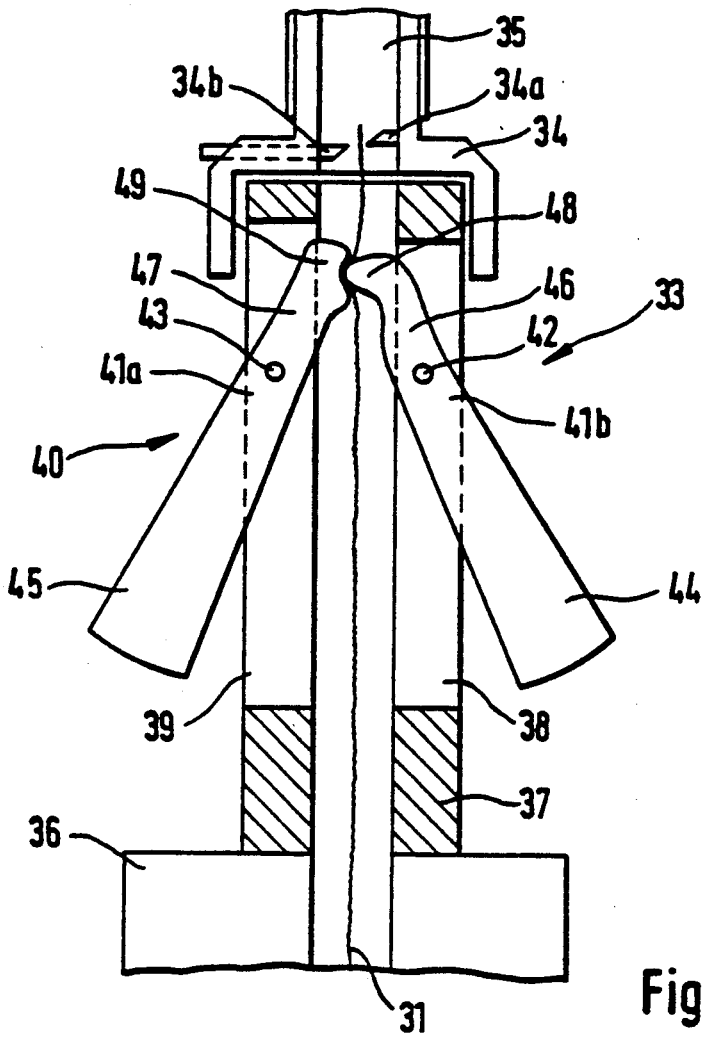
FIG. 6 is an enlarged view of a twisting device of the embodiment according to FIG. 5.

FIG. 6 is an enlarged representation of a twisting device 33. The twisting device 33 is preferably used in the case of the embodiment illustrated in FIG. 5 because the introduction of a yarn portion into a tube 37 of the twisting device 33 in combination with a suction tube 32 that will be used is particularly simple. The twisting device 33 essentially comprises the tube 37 which is rotatably disposed in a bearing 36. The tube 37 has lateral window-type recesses 38, 39 which are disposed opposite one another. A double lever **41*a*, 41*b* is in each case disposed in the recesses 38, 39 by way of a pin 42, 43. The double levers 41*a*, 41*b*, which act as the clamping element, are pivotally disposed on the pins 42, 43. During this pivotal movement, the longer legs 44 and 45 of the double lever project toward the outside out of the recesses 38 and 39, in which case the shorter legs 46 and 47 move toward one another toward the inside until they come in contact with one another, and the nose 48 of the double lever 41*b* comes to rest in an assigned recess 49 of the double lever 41*a*. In the rest position, the double levers 41*a*, 41*b* are completely accommodated in the pertaining recesses 38, 39 so that no secondary air can penetrate into the tube 37. In the inoperative position of the double levers 41*a*, 41*b*, the suction air can flow through without any impairment. In the area of the twisting device 33, the cutting device 34 is arranged which has two blades 34*a*, 34*b* which are arranged opposite one another. The blades 34*a*, 34*b*** can be operated from the outside by devices which are not shown in detail.

In the case of a twisting operation, the yarn portion 31 to be twisted is introduced into the interior of the tube 37, the inside cross-section of which is constructed in the shape of a square. For carrying out the twisting, the tube 37 is rotated inside the bearing 36. During the rotating movement of the tube 37, because of the effect of the centrifugal forces, the longer legs 44, 45 of the double levers **41*a*, 41*b* are swivelled radially toward the outside, in which case the shorter legs 46, 47 move toward the inside. In the process, the yarn portion 31 is clamped in between the recess 49 of the double lever 41*a* and the nose 48 of the double lever 41*a*. At the same time, the yarn portion 31 is provided with a true twist in the area between the spool package 20 and the clamping element 40. Prior to that, the yarn portion extending beyond the cutting device 34 was cut off and removed through the tube piece 35**.

Figure 7:
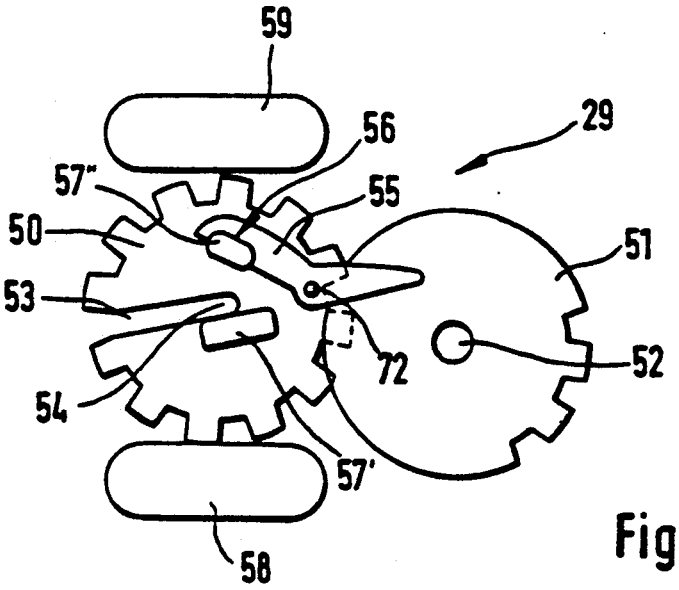
FIG. 7 is a view of another embodiment of a twisting device.

FIG. 7 illustrates another embodiment of a twisting device which is particularly suitable for use on a swivel arm 30 illustrated in FIGS. 2 and 3. The twisting device 29 of FIG. 7 comprises essentially a slotted disk 50 which has an approximately U-shaped slot 53 extending from its circumference to its center. The center of the slotted disk 50 is constructed as a receiving device 54 for the yarn to be twisted. For clamping the yarn to be twisted into the center of the slotted disk 50, the clamping element 56 is provided with two cushions 57', 57'' which can be brought to rest against one another. In this case, cushion 57'' is arranged on a lever 55 which can be swivelled about a pin 72 fastened to the slotted disk 50.

The lever 55 can be actuated from the outside against the force of a spring which is not shown in the drawing so that the cushion 57" comes to rest against the cushion 57' which is arranged in the area of the receiving device 54. Instead of the lever 55 which can be actuated from the outside, a lever may be provided which is actuated by centrifugal force. The slotted disk 50 is toothed on its outer edge and engages into a corresponding toothing of a driving wheel 51. The driving wheel 51 is disposed to be rotatable about a shaft 52. On its circumference, the driving disk 51 is magnetized in the form of a ring. As a result, the slotted disk 50, in the case of which, because of the slot 53, a conventional radial bearing is not provided, is held in contact with the driving disk 51. In order to prevent undesirable radial movements, lateral rims 58, 59 are provided.

Figure 8:
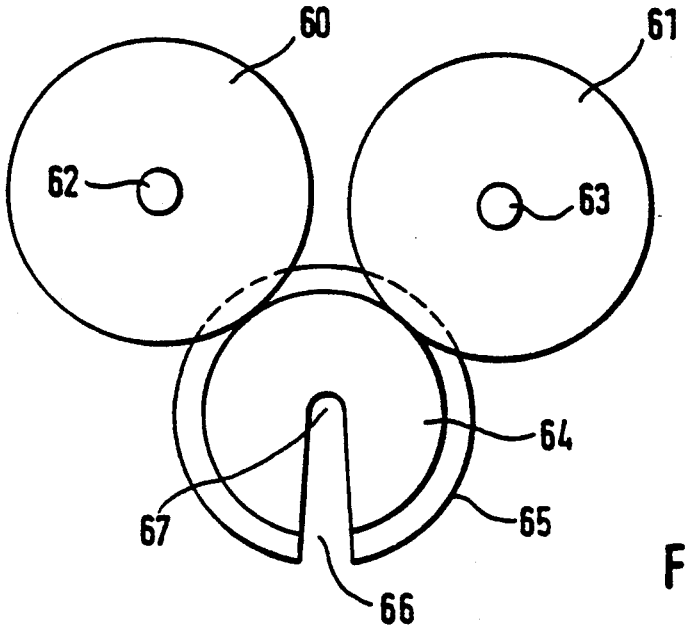
FIG. 8 is a view of another embodiment of a twisting device.
Figure 9:
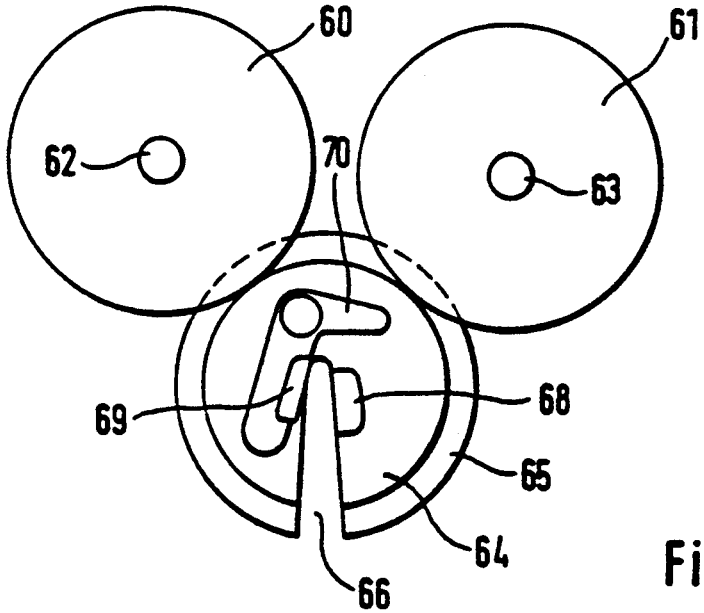
FIG. 9 is a rear view of the twisting device illustrated in FIG. 8.

The embodiment of a twisting device illustrated in FIGS. 8 and 9 in principle operates similarly to the twisting device 29 according to FIG. 7. This twisting device is also particularly suitable for use in the embodiments illustrated in FIGS. 2 and 3. The twisting device shown in FIGS. 8 and 9 comprises essentially a slotted disk which has a slot 66 extending from its circumference to the center. In the center, a receiving device 67 is provided for the yarn to be twisted. The slotted disk 64 has an edge 65 for the avoiding of axial displacements. The drive of the slotted disk 64 takes place by means of two driving disks 60, 61 which are each rotatably disposed on pins 62, 63. A drive, which is not shown in detail, drives the driving disks 60, 61. The contact with the slotted disk 64 is ensured by means of a magnetizing of the driving disks 60, 61. As a result, a lateral moving-away of the slotted disk 64 is avoided. The yarn portion, which is to be introduced through the slot 66 of the slotted disk 64 for the twisting is clamped fast by means of cushions 68, 69 which can be brought to rest against one another. Cushion 69 is arranged on a lever 70 which can be actuated from outside the slotted disk 64 against the force of a spring. The yarn, which is clamped fast in the receiving device 67 by means of the cushions 68, 69, receives the desired twisting as a result of the rotating movement of the slotted disk 64.

Instead of the centrifugal force effect, a magnet may also be used for the clamping of the yarn which acts upon the lever 70 from outside the twisting device.

In the case of the twisting devices illustrated in FIGS. 7 and 8 in which the levers 55, 70 can be actuated from the outside, a separate gripping element is not necessary. The clamping element of the twisting devices can at the same time operate as a gripping element.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for strengthening of an end portion of a yarn which is produced at a spinning station of a spinning machine comprising a plurality of such spinning stations and which yarn, after the interruption of the spinning operation, extends between a stopped spool package and a suction withdrawal device assigned to the spinning station, said process comprising:

gripping a yarn end projecting into the suction withdrawal device;

lengthening the yarn end portion by winding-off the yarn would up on the package; and twisting the yarn end portion while it is in an essentially stationary position to thereby strengthen the yarn end portion by applying a true twist thereto.

2. A process according to claim 1, comprising holding the yarn end portion to be strengthened in a clamped position during the strengthening.

3. A process according to claim 2, wherein the twisting includes a mechanical non-pneumatic twisting of the yarn end portion situated between a clamping element and the package.

4. A process according to claim 3, comprising cutting off an end part of the yarn which is not to be strengthened.

5. A process according to claim 4, comprising controlling the length of the yarn end portion to be strengthened by controlling an application point of the twisting with respect to the stopped spool package.

6. A process according to claim 4, wherein said gripping includes gripping the yarn end projecting into the suction withdrawal device by means of a gripping element, wherein said lengthening includes sucking said yarn end together with a yarn portion wound off the spool package into a suction tube which is separate from the suction withdrawal device and is applied to the spinning station, wherein said strengthening is then applied in an area of the yarn end.

7. A process according to claim 3, comprising controlling the length of the yarn end portion to be strengthened by controlling an application point of the twisting with respect to the stopped spool package.

8. A process according to claim 3, wherein said gripping includes gripping the yarn end projecting into the suction withdrawal device by means of a gripping element, wherein said lengthening includes sucking said yarn end together with a yarn portion wound off the spool package into a suction tube which is separate from the suction withdrawal device and is applied to the spinning station, wherein said strengthening is then applied in an area of the yarn end.

9. A process according to claim 2, comprising cutting off an end part of the yarn which is not to be strengthened.

10. A process according to claim 2, comprising controlling the length of the yarn end portion to be strengthened by controlling an application point of the twisting with respect to the stopped spool package.

11. A process according to claim 1, comprising cutting off an end part of the yarn which is not to be strengthened.

12. A process according to claim 11, wherein said gripping includes gripping the yarn end projecting into the suction withdrawal device by means of a gripping element, wherein said lengthening includes sucking said yarn end together with a yarn portion wound off the spool package into a suction tube which is separate from the suction withdrawal device and is applied to the spinning station, wherein said strengthening is then applied in an area of the yarn end.

13. A process according to claim 1, comprising controlling the length of the yarn end portion to be strengthened by controlling an application point of the twisting with respect to the stopped spool package.

14. A process according to claim 13, wherein said gripping includes gripping the yarn end projecting into the suction withdrawal device by means of a gripping element, wherein said lengthening includes sucking said yarn end together with a yarn portion wound off the spool package into a suction tube which is separate from the suction withdrawal device and is applied to the spinning station, wherein said strengthening is then applied in an area of the yarn end.

15. A process according to claim 1, wherein said gripping includes gripping the yarn end projecting into the suction withdrawal device by means of a gripping element, wherein said lengthening includes sucking said yarn end together with a yarn portion wound off the spool package into a suction tube which is separate from the withdrawal device and is applied to the spinning station, wherein said strengthening is then applied in an area of the yarn end.

16. An arrangement for strengthening of an end portion of a yarn which is produced at a spinning station of a spinning machine comprising a plurality of such spinning stations and which, after the interruption of the spinning operation, extends between a stopped spool package and a suction withdrawal device assigned to the spinning station, said arrangement comprising:

a suction withdrawal pipe which is connected downstream of the suction withdrawal device of the spinning station;

spool package drive uncoupling devices for uncoupling a drive of a spool package receiving the spun yarn;

a controllable gripping element selectively grippingly engageable with the yarn projecting into the withdrawal pipe;

guiding devices for guiding the yarn away from the withdrawal pipe; and a twisting device for twisting the yarn end portion of the yarn which leads onto the spool package to thereby strengthen the yarn end portion by applying a true twist to said yarn end portion while it is in an essentially stationary position.

17. An arrangement according to claim 16, wherein the twisting device includes a clamping element for the yarn to be strengthened.

18. An arrangement according to claim 17, wherein the clamping element of the twisting device is constructed as a gripping element.

19. An arrangement according to claim 18, wherein the twisting device has a rotatably arranged, drivable slotted disk with a radially arranged slot which extends to the center and into which the yarn to be strengthened can be introduced and can be fixed by means of a yarn clamp arranged on the slotted disk.

20. An arrangement according to claim 19, wherein the slotted disk is rotatable by means of an assigned driving disk.

21. An arrangement according to claim 20, wherein the slotted disk and the driving disk are magnetically connected with one another.

22. An arrangement according to claim 20, wherein the slotted disk and the driving disks are each provided with an external toothing.

23. An arrangement according to claim 20, wherein the slotted disk can be driven by means of two magnetic driving disks which are applied to its circumference.

24. An arrangement according to claim 19, wherein the slotted disk is arranged between rims.

25. An arrangement according to claim 16, wherein the gripping element and the twisting device are assigned to a servicing arrangement which is arranged to be movable along the spinning machine to be selectively applied to the spinning stations.

26. An arrangement according to claim 25, wherein the gripping element and the twisting device are arranged on a swivel arm which can be jointly applied to the spinning stations.

27. An arrangement according to claim 25, wherein a suction tube is provided which can be applied to the withdrawal pipe and is assigned to the servicing arrangement, the suction tube being provided on its mouth opening facing away from the servicing arrangement with a yarn clamp serving as the controllable gripping element, and wherein the twisting device is located at an end of the suction tube opposite its mouth opening.

28. An arrangement according to claim 27, wherein the twisting device is constructed as a rotatably driven tube into which the yarn to be strengthened is introduced and to which a clamping element is assigned for clamping the yarn.

29. An arrangement according to claim 28, wherein two clamping devices are provided as the clamping element which can be introduced into an interior space of the rotatably driven tube and is brought to rest against one another to clamp the yarn therebetween.

30. An arrangement according to claim 29, wherein the clamping elements are constructed as wing-type double levers which are received in recesses of the rotatably driven tube which are situated opposite one another and are arranged in the recesses so that they is swivelled on pins in such a manner that, in each case, a shorter and a longer leg is formed on the double lever so that during the rotation of the tube centrifugal forces move the longer legs toward the outside and the shorter legs are moved toward the inside, the yarn introduced into the tube being clamped between the shorter legs.

31. An arrangement according to claim 30, wherein the rotatably driven tube has a rectangular cross-section in the area in which the double levers are arranged.

32. An arrangement according to claim 31, wherein the double levers completely fill out the recesses in their inoperative position.

33. An arrangement according to claim 30, wherein the double levers completely fill out the recesses in their inoperative position.

34. An arrangement according to claim 16, wherein a cutting device is assigned to the twisting device by means of which an end portion of the yarn which is not intended for strengthening is cut off.

* * * * *